US008931887B2

(12) United States Patent
Aoki et al.

(10) Patent No.: US 8,931,887 B2
(45) Date of Patent: Jan. 13, 2015

(54) LIQUID CONSUMPTION APPARATUS, LIQUID SUPPLY MEMBER, AND LIQUID SUPPLY SYSTEM

(71) Applicant: Seiko Epson Corporation, Tokyo (JP)

(72) Inventors: Yuji Aoki, Nagano (JP); Hiroshi Satoh, Yamanashi (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 13/736,433

(22) Filed: Jan. 8, 2013

(65) Prior Publication Data

US 2013/0182050 A1 Jul. 18, 2013

(30) Foreign Application Priority Data

Jan. 13, 2012 (JP) ..... 2012-005347
Jan. 25, 2012 (JP) ..... 2012-013238
Feb. 6, 2012 (JP) ..... 2012-022822

(51) Int. Cl.
*B41J 2/175* (2006.01)
*B41J 2/17* (2006.01)

(52) U.S. Cl.
CPC ..... *B41J 2/1721* (2013.01); *B41J 2/1752* (2013.01); *B41J 2/17509* (2013.01); *B41J 2/17552* (2013.01)
USPC ..... 347/86

(58) Field of Classification Search
USPC ..... 347/84, 85, 86
See application file for complete search history.

(56) References Cited

U.S. PATENT DOCUMENTS

| | | | | |
|---|---|---|---|---|
| 5,896,151 | A | 4/1999 | Miyazawa et al. | |
| 6,106,112 | A | 8/2000 | Okubo et al. | |
| 6,220,702 | B1 | 4/2001 | Nakamura et al. | |
| 6,422,674 | B1 | 7/2002 | Hinami et al. | |
| 6,435,673 | B1 | 8/2002 | Hattori et al. | |
| 6,540,342 | B2 | 4/2003 | Koshikawa et al. | |
| 6,591,874 | B2 | 7/2003 | Credle, Jr. | |
| 6,609,789 | B1 | 8/2003 | Hunt | |
| 7,178,908 | B2 * | 2/2007 | Katayama | 347/85 |
| 7,178,910 | B2 * | 2/2007 | Suzuki et al. | 347/86 |
| 7,380,921 | B2 * | 6/2008 | Nanjo et al. | 347/84 |
| 7,452,062 | B2 | 11/2008 | Kimura et al. | |
| 7,814,656 | B2 | 10/2010 | Prasad | |
| 7,984,980 | B2 | 7/2011 | Kachi | |
| D656,184 | S | 3/2012 | Iwamuro et al. | |
| 8,197,045 | B2 | 6/2012 | Takeuchi | |
| D682,929 | S | 5/2013 | Aoki et al. | |

(Continued)

FOREIGN PATENT DOCUMENTS

| | | | |
|---|---|---|---|
| CA | 2782610 | A1 | 12/2011 |
| CN | 101130309 | A | 2/2008 |

(Continued)

*Primary Examiner* — Kristal Feggins
(74) *Attorney, Agent, or Firm* — Global IP Counselors, LLP

(57) ABSTRACT

A liquid consumption apparatus, onto which a liquid supply member is mounted, includes a liquid delivery unit, a liquid accepting unit and an abutting section. The liquid delivery unit is configured to deliver a liquid from the liquid supply member. The liquid accepting unit is provided below the liquid delivery unit. The abutting section abuts against the liquid supply member. The liquid accepting unit is provided to the abutting section. In a state where the abutting section and the liquid supply member abut against each other, the liquid accepting unit protrudes out closer toward the liquid supply member than a surface where the liquid supply member and the abutting section abut against each other.

12 Claims, 12 Drawing Sheets

(56) References Cited

U.S. PATENT DOCUMENTS

| | | | |
|---|---|---|---|
| D682,930 | S | 5/2013 | Aoki et al. |
| D682,931 | S | 5/2013 | Aoki et al. |
| D712,466 | S | 9/2014 | Nagashima et al. |
| 2003/0234844 | A1 | 12/2003 | Yamamoto et al. |
| 2006/0012638 | A1 | 1/2006 | Lee |
| 2006/0038865 | A1 | 2/2006 | Nagasaki et al. |
| 2008/0049081 | A1 | 2/2008 | Hayashi et al. |
| 2008/0151018 | A1 | 6/2008 | Aoki et al. |
| 2008/0198211 | A1 | 8/2008 | Aoki et al. |
| 2008/0252669 | A1 | 10/2008 | Aoki et al. |
| 2008/0252702 | A1 | 10/2008 | Aoki et al. |
| 2008/0316249 | A1 | 12/2008 | Aoki et al. |
| 2009/0064501 | A1 | 3/2009 | Kimura et al. |
| 2009/0289971 | A1 | 11/2009 | Gilson et al. |
| 2009/0303299 | A1 | 12/2009 | Gilson et al. |
| 2011/0198360 | A1 | 8/2011 | Aoki |
| 2011/0199439 | A1 | 8/2011 | Aoki |
| 2012/0147102 | A1 | 6/2012 | Aoki et al. |
| 2012/0200646 | A1 | 8/2012 | Karasawa et al. |
| 2012/0200871 | A1 | 8/2012 | Takahashi et al. |
| 2012/0212526 | A1 | 8/2012 | Karasawa et al. |
| 2012/0242762 | A1 | 9/2012 | Gilson et al. |
| 2013/0182050 | A1 | 7/2013 | Aoki et al. |
| 2013/0182051 | A1 | 7/2013 | Aoki et al. |
| 2013/0186513 | A1 | 7/2013 | Aoki et al. |
| 2013/0187993 | A1 | 7/2013 | Aoki et al. |
| 2013/0188985 | A1 | 7/2013 | Takahashi et al. |
| 2013/0194357 | A1 | 8/2013 | Karasawa et al. |
| 2013/0201260 | A1 | 8/2013 | Aoki et al. |
| 2013/0223877 | A1 | 8/2013 | Takahashi et al. |
| 2013/0278687 | A1 | 10/2013 | Karasawa et al. |
| 2013/0307908 | A1 | 11/2013 | Aoki et al. |

FOREIGN PATENT DOCUMENTS

| | | | |
|---|---|---|---|
| CN | 102036828 | A | 4/2011 |
| CN | 102285237 | A | 12/2011 |
| EP | 1504908 | A2 | 2/2005 |
| EP | 1547783 | A2 | 6/2005 |
| EP | 1892103 | A2 | 2/2008 |
| EP | 2308337 | A1 | 12/2011 |
| EP | 2397336 | A1 | 12/2011 |
| JP | 2002-178544 | A | 6/2002 |
| JP | 2005-047089 | A | 2/2005 |
| JP | 2006-082292 | A | 3/2006 |
| JP | 2007-083677 | A | 4/2007 |
| JP | 2010-158906 | A | 7/2010 |
| JP | 2012-226289 | A | 11/2012 |
| WO | WO-2007/037528 | A1 | 4/2007 |

* cited by examiner

LIQUID CONSUMPTION APPARATUS, LIQUID SUPPLY MEMBER, AND LIQUID SUPPLY SYSTEM

CROSS-REFERENCE TO RELATED APPLICATIONS

This application claims priority to Japanese Patent Application No. 2012-022822 filed on Feb. 6, 2012, Japanese Patent Application No. 2012-005347 filed on Jan. 13, 2012, and Japanese Patent Application No. 2012-013238 filed on Jan. 25, 2012. The entire disclosures of Japanese Patent Application Nos. 2012-022822, 2012-005347 and 2012-013238 are hereby incorporated herein by reference.

BACKGROUND

1. Technical Field

The present invention relates to a liquid consumption apparatus.

2. Related Art

In general, a print apparatus that uses ink as a print material has mounted therein a cartridge in the interior of which the ink is accommodated. In such a print apparatus, in a case where the cartridge is removed from the print apparatus, there have conventionally been some cases where the ink may leak from a connecting portion that connects the print apparatus and the cartridge together. In order to cope with such ink leakage, for example, the ink tank unit set forth in Japanese Laid-Open Patent Publication No. 2002-178544 has a re-absorption member for absorbing ink that has leaked out, the re-absorption member being provided to a joint mouth adapted for ink to be supplied to a recording head of the print apparatus. The ink cartridge set forth in Japanese Laid-Open Patent Publication No. 2010-158906 has an ink collection space for preventing ink dripping, the ink collection space being provided to a supply cap of an ink supply mechanism for supplying ink to a print apparatus. In the printer set forth in Japanese Laid-Open Patent Publication No. 2006-82292, ink that leaks out from a removal port of an ink cartridge is absorbed by an exposed section of an absorber body provided to a print apparatus side so as to be in contact with the removal port.

SUMMARY

However, the technologies set forth in Japanese Laid-Open Patent Publication No. 2002-178544 and Japanese Laid-Open Patent Publication No. 2010-158906 are technologies for preventing ink dripping on the cartridge side, and thus fail to take into account ink dripping from the print apparatus side. Also, in the technology set forth in Japanese Laid-Open Patent Publication No. 2006-82292, there is a possibility that a case where ink has already been absorbed by the exposed section of the absorber body will result in the ink sticking around the vicinity of the removal port of the ink cartridge. For this reason, there has been a need for a technique that makes it possible to more favorably cope with ink dripping during removal of the cartridge.

The present invention has been contrived in order to resolve the foregoing problems at least in part, and can be implemented as the following modes or application examples.

According to one aspect, a liquid consumption apparatus, onto which a liquid supply member is mounted, includes a liquid delivery unit, a liquid accepting unit and an abutting section. The liquid delivery unit is configured to deliver a liquid from the liquid supply member. The liquid accepting unit is provided below the liquid delivery unit. The abutting section abuts against the liquid supply member. The liquid accepting unit is provided to the abutting section. In a state where the abutting section and the liquid supply member abut against each other, the liquid accepting unit protrudes out closer toward the liquid supply member than a surface where the liquid supply member and the abutting section abut against each other.

According to the configuration of such description, even though liquid may leak out from a connecting portion connecting the liquid supply member and the liquid delivery unit, it is possible for the liquid to be caught by the liquid accepting unit, which is provided vertically below the liquid delivery unit, and to be guided to the first absorbent material. It is accordingly possible to more favorably cope with ink dripping during removal of the liquid supply member.

The liquid consumption apparatus as set forth in the above described aspect is preferably further provided with a gutter member configured to guide the liquid from the liquid accepting unit toward the first absorbent material. According to the configuration of such description, it is possible for the liquid to be reliably guided toward the first absorbent material by the gutter member.

In the liquid consumption apparatus as set forth in the above described aspect, the liquid accepting unit is preferably configured such that an inner wall of a bottom section descends vertically downward with respect to a mounting direction in which the liquid supply member is mounted onto the liquid consumption apparatus. According to the configuration of such description, the liquid that has been caught by the liquid accepting unit can be made to flow toward the liquid consumption apparatus side.

In the liquid consumption apparatus as set forth in the above described aspect, the liquid accepting unit is preferably configured so that the width thereof becomes wider going in the mounting direction in which the liquid supply member is mounted onto the liquid consumption apparatus. According to the configuration of such description, the liquid accepting unit can be easily entered into the liquid supply member side.

In the liquid consumption apparatus as set forth in the above described aspect, the liquid consumption apparatus is preferably further provided with a rod member, one end of which abuts against a predetermined contact point provided to the liquid supply member and the other end of which is detected in the interior of the liquid consumption apparatus when the liquid supply member has been mounted onto the liquid consumption apparatus; the liquid accepting unit being provided vertically above the rod member. According to the configuration of such description, it is possible to prevent the liquid from dripping onto the rod member and hindering movement of the rod member.

In the liquid consumption apparatus as set forth in the above described aspect, the liquid consumption apparatus is preferably further provided with an urging member configured to urge the liquid accepting unit in a direction opposite to the mounting direction in which the liquid supply member is mounted onto the liquid consumption apparatus, when the liquid supply member is removed from the liquid delivery unit.

In the liquid consumption apparatus as set forth in the above described aspect, a second absorbent material configured to absorb the liquid is preferably provided so as to be in contact with the liquid delivery unit, closer than the delivery port in the mounting direction in which the liquid supply member is mounted onto the liquid consumption apparatus.

According to the configuration of such description, it is possible to cause the liquid, which follows along the liquid delivery unit, to be absorbed by the second absorbent material.

The liquid consumption apparatus as set forth in the above described aspect, the second absorbent material is preferably in contact with the inner wall of the liquid accepting unit. According to the configuration of such description, it is possible for the liquid that has been caught by the liquid accepting unit to be temporarily absorbed by the second absorbent material.

A liquid supply member according to another aspect is mounted onto a liquid consumption apparatus, and the liquid supply member includes a liquid supply unit and a surface. The liquid supply unit is configured to supply a liquid to a liquid delivery unit provided to the liquid consumption apparatus. The liquid supply unit is connected to the liquid delivery unit. An indent is formed on the surface, in which at least a part of a liquid accepting unit provided vertically below the liquid delivery unit is accommodated when the liquid supply member has been mounted onto the liquid consumption apparatus. According to the configuration of such description, even though liquid may leak out from a connecting portion connecting the liquid supply unit and the liquid delivery unit, it is possible for the liquid to be caught by the liquid accepting unit, which is provided vertically below the liquid delivery unit. It is accordingly possible to more favorably cope with ink dripping during removal of the liquid supply member.

In the liquid supply member as set forth in the above described aspect, the liquid supply member is preferably further provided with a contact section against which abuts one end of a rod member provided to the liquid consumption apparatus, the position of the other end of the rod member being detected in the interior of the liquid consumption apparatus, when the liquid supply member has been mounted onto the liquid consumption apparatus. The indent is preferably provided so as to be positioned vertically above the contact section when the liquid supply member has been mounted onto the liquid consumption apparatus. According to the configuration of such description, it is possible to prevent the liquid from dripping onto the rod member and hindering displacement of the rod member.

A liquid supply system according to another aspect includes the liquid supply member as set forth in the above described aspect, and a liquid storage unit configured to store the liquid being supplied to the liquid supply member. According to the configuration of such description, it is possible to increase the capacity of the liquid storage unit and thereby supply a large amount of the liquid to the liquid consumption apparatus.

The liquid supply system as set forth in the above described aspect, the liquid supply system is preferably further provided with a tube through which the liquid is supplied to the liquid supply member from the liquid storage unit. According to the configuration of such description, it is possible for the liquid supply unit to be disposed at a separate location from the liquid supply member.

The present invention is not limited to being in the mode of the above-described liquid consumption apparatus, liquid supply member, and liquid supply system described above, but rather can also be implemented by a variety of other modes, such as, for example, a method for producing a liquid consumption apparatus or liquid supply member, methods for using same, or the like.

BRIEF DESCRIPTION OF THE DRAWINGS

Referring now to the attached drawings which form a part of this original disclosure.

DETAILED DESCRIPTION OF EXEMPLARY EMBODIMENTS

Figure 1:
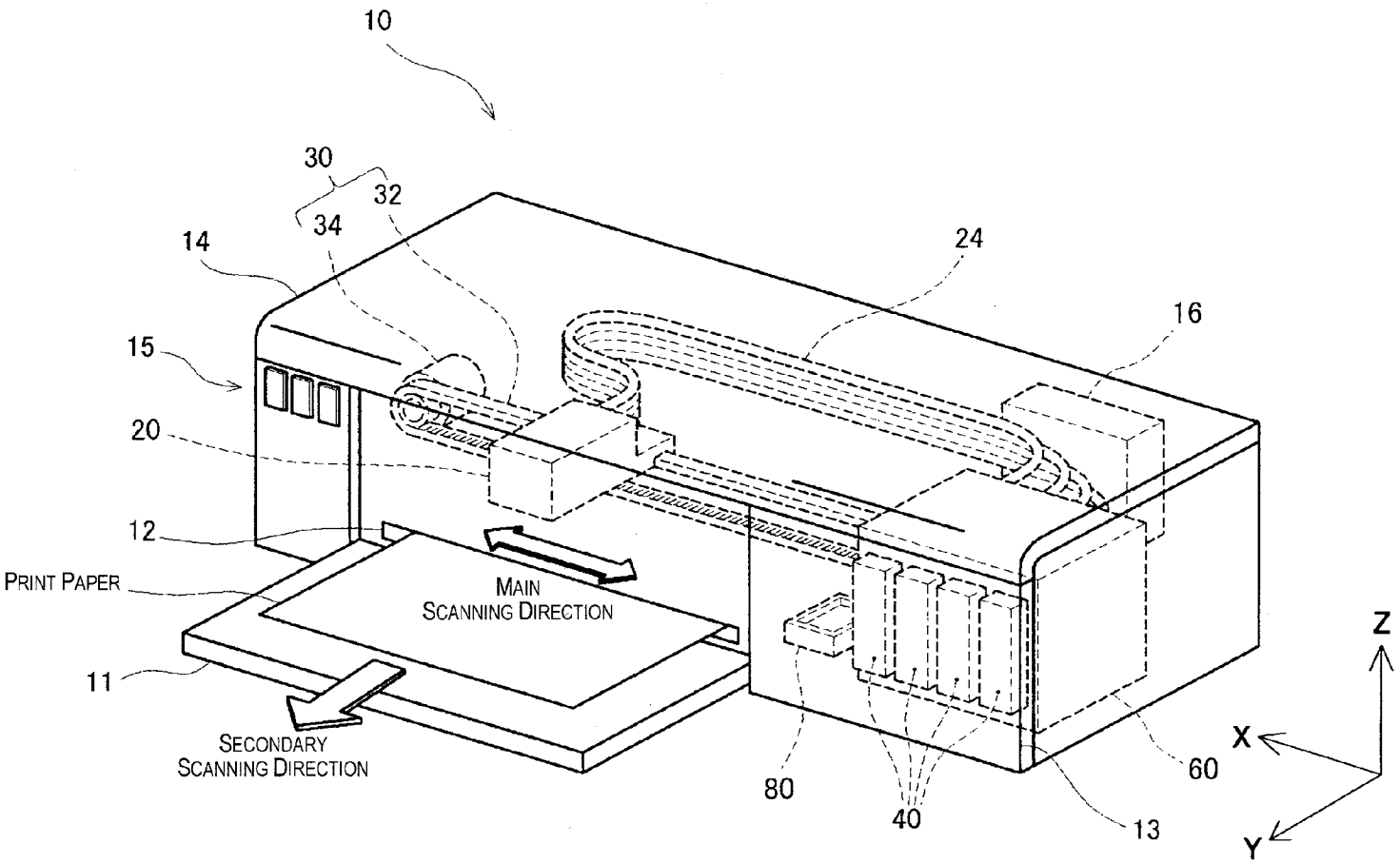
FIG. 1 is a diagram illustrating a schematic configuration of an inkjet-type print apparatus serving as one embodiment of the present invention.
Figure 6:
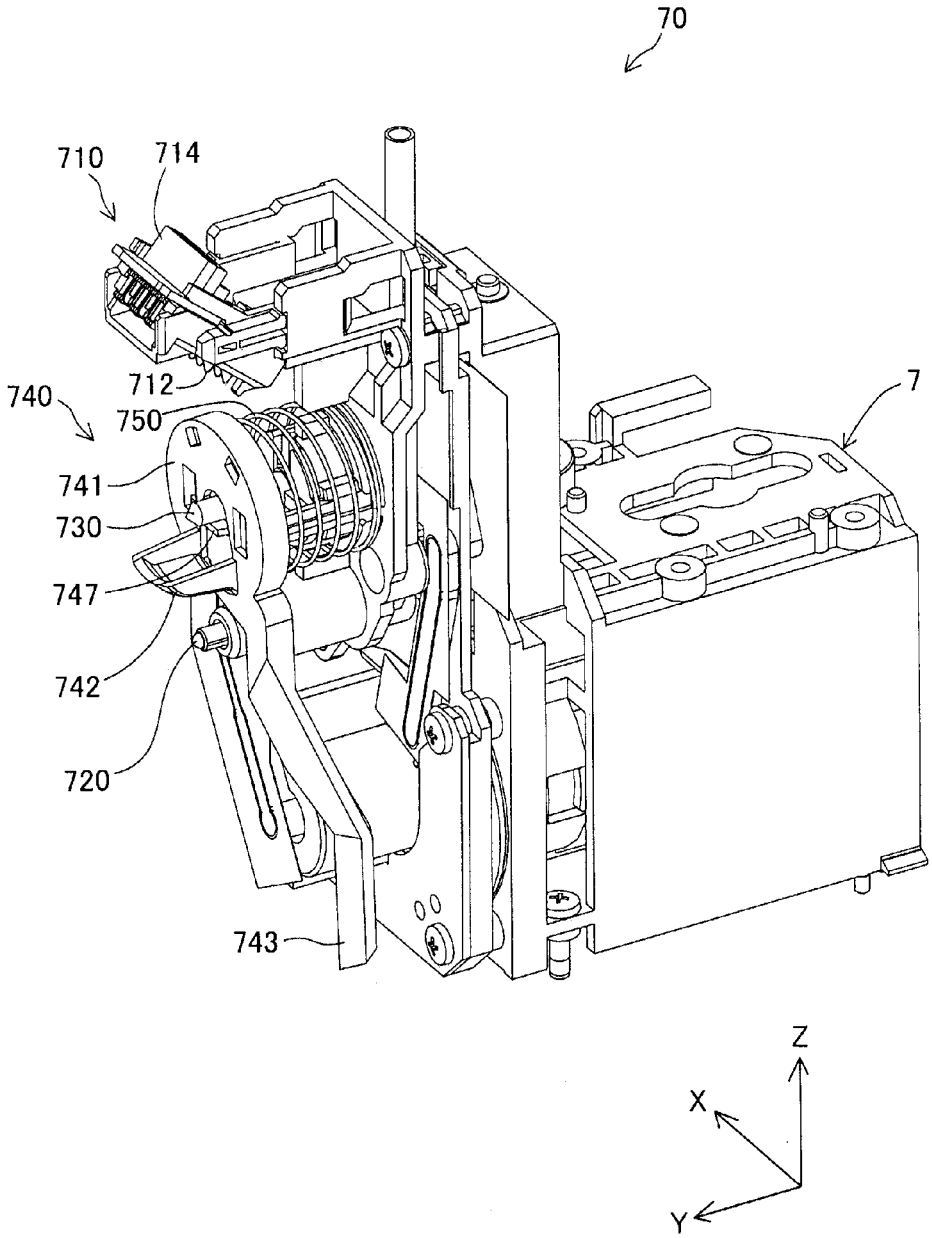
FIG. 6 is a detailed perspective view of an ink delivery mechanism.

FIG. 1 is a diagram illustrating a schematic configuration of an inkjet-type print apparatus serving as one embodiment of the present invention. X-, Y- and Z-axes, which are orthogonal to each other, are drawn in FIG. 1. The X-, Y-, and Z-axes in FIG. 1 correspond to the X-, Y-, and Z-axes of the other drawings. Drawings illustrated hereinbelow have also been labeled with X-, Y-, and Z-axes as needed. In the present embodiment, in a posture of use of a print apparatus 10, the Z-axis is the vertical direction (the direction of gravity), the Y-axis is the direction of attachment/removal of a cartridge 40 with respect to a cartridge holder 60, and the X-axis is a direction in which a plurality of the cartridges 40 are arranged side by side. More specifically, the +Z-axis direction is the vertically upward direction, the −Z-axis direction is the vertically downward direction, the +Y-axis direction is the direction in which the cartridge 40 is pulled out, the −Y-axis direction is the direction in which the cartridge 40 is inserted, the +X-axis direction is the direction of the side where a predetermined label LB (see FIG. 4) is pasted onto the cartridge 40, and the −X-axis direction is the direction of the back surface thereof Hereinbelow, in some cases, the +Z-axis direction is called "up"/"above", the −Z-axis direction is called "down"/"below", the +Y-axis direction is called "front"/"forward", and the −Y-axis direction is called "back"/"rear". The Z-axis direction is also a direction in which an ink delivery needle 730 and a terminal 712 which are illustrated in FIG. 6 are arranged side by side. The +Z-axis direction is a direction toward the terminal 712 from the ink delivery needle 730, and the −Z-axis direction is the direction opposite thereto.

The print apparatus 10, serving as a liquid consumption apparatus, is shaped to have a substantially box-shaped external appearance. A front surface cover 11 is provided to substantially the middle of the front of the printer 10, and a plurality of operation buttons 15 are provided on a +X-axis direction side thereof. The front surface cover 11 is pivotally supported at the lower end side, and when the upper end side is brought down forward, a paper discharge port 12 from which print paper is discharged appears. A paper feed tray (not shown) is also provided to a rear surface side of the print apparatus 10. When the print paper is set up in the paper feed tray and the operation buttons 15 are operated, the print paper is fed from the paper feed tray, an image or the like is printed onto the surface in the interior, and thereafter the print paper is discharged from the paper discharge port 12.

An upper surface cover 14 is provided to the upper surface side of the print apparatus 10. The upper surface cover 14 is pivotally supported at the back; when the front side is lifted upward to open the upper surface cover 14, it is possible either to check the state of the interior of the print apparatus 10 or to make repairs and the like for the print apparatus 10.

A spray head 20 for forming an ink jet onto the print paper while moving reciprocatingly in a main scanning direction is built into the interior of the print apparatus 10, as is a drive mechanism 30 for reciprocatingly moving the spray head 20. A plurality of spray nozzles are provided to a bottom surface side of the spray head 20 (a side facing the print paper), and ink is sprayed from the spray nozzles toward the print paper.

The ink sprayed from the spray nozzles is accommodated in the cartridges 40. The cartridges 40 are loaded into a cartridge holder 60 provided to a position separate from the spray head 20. The ink inside the cartridges 40 is supplied to the spray head 20 via ink tubes 24. In the print apparatus 10 of the present embodiment, a cover 13 for cartridge replacement is provided to the right of the front surface cover 11, the cover for cartridge replacement being pivotally supported at the lower end side. By bringing the upper end side of the cover 13 for cartridge replacement down forward, it is possible to mount the cartridges 40 into the cartridge holder 40 or detach same therefrom. The cartridges 40 are equivalent to the "liquid supply member" of the present application.

The print apparatus 10 is able to use four types of ink, namely, cyan-colored, magenta-colored, yellow-colored, and black-colored ink, to print a color image. Spray nozzles are provided to the spray head 20 for every type of ink. Ink inside a corresponding cartridge 40 is supplied to the respective spray nozzle via an ink tube 24 provided for every type of ink. In the present embodiment, the print apparatus 10 uses four types of ink to carry out printing, but five or more types or three or fewer types of ink may also be used to carry out printing.

A drive mechanism 30 for reciprocatingly moving the spray head 20 is provided with a timing belt 32 on the inside of which a plurality of tooth marks are formed, a drive motor 34 for driving the timing belt 32, and the like. A part of the timing belt 32 is fixed to the spray head 20. When the timing belt 32 is driven, the spray head 20 is reciprocatingly moved in the main scanning direction while being guided by a guide rail (not shown) provided so as to extend in the main scanning direction.

A region called the "home position" is provided to a position outside a print region where the spray head 20 is moved in the main scanning direction. A maintenance mechanism is loaded in at the home position. The maintenance mechanism is provided with: a cap 80 which is pressed up against a surface (a nozzle surface) on the base surface side of the spray head 20 where the spray nozzles are formed, thus forming an enclosed space so as to surround the spray nozzles; a vertical motion mechanism (not shown) for vertically moving the cap 80 in order to press same up against the nozzle surface of the spray head 20; a suction pump (not shown) for delivering a negative pressure to the enclosed space formed by the cap 80 being pressed up against the nozzle surface of the spray head 20; and the like.

Also loaded into the interior of the print apparatus 10 are a paper issuing mechanism (not shown) for issuing forth the print paper, and a control unit 16 for controlling the operation of the entirety of the print apparatus 10. The control unit 16 is provided with a CPU, a ROM, and a RAM. The operation for reciprocatingly driving the spray head 20, the operation for issuing forth the print paper, the operation for spraying the ink from the spray nozzles, the operation for implementing maintenance so as to enable normal printing, and the like are all controlled by the control unit 16.

Figure 2:
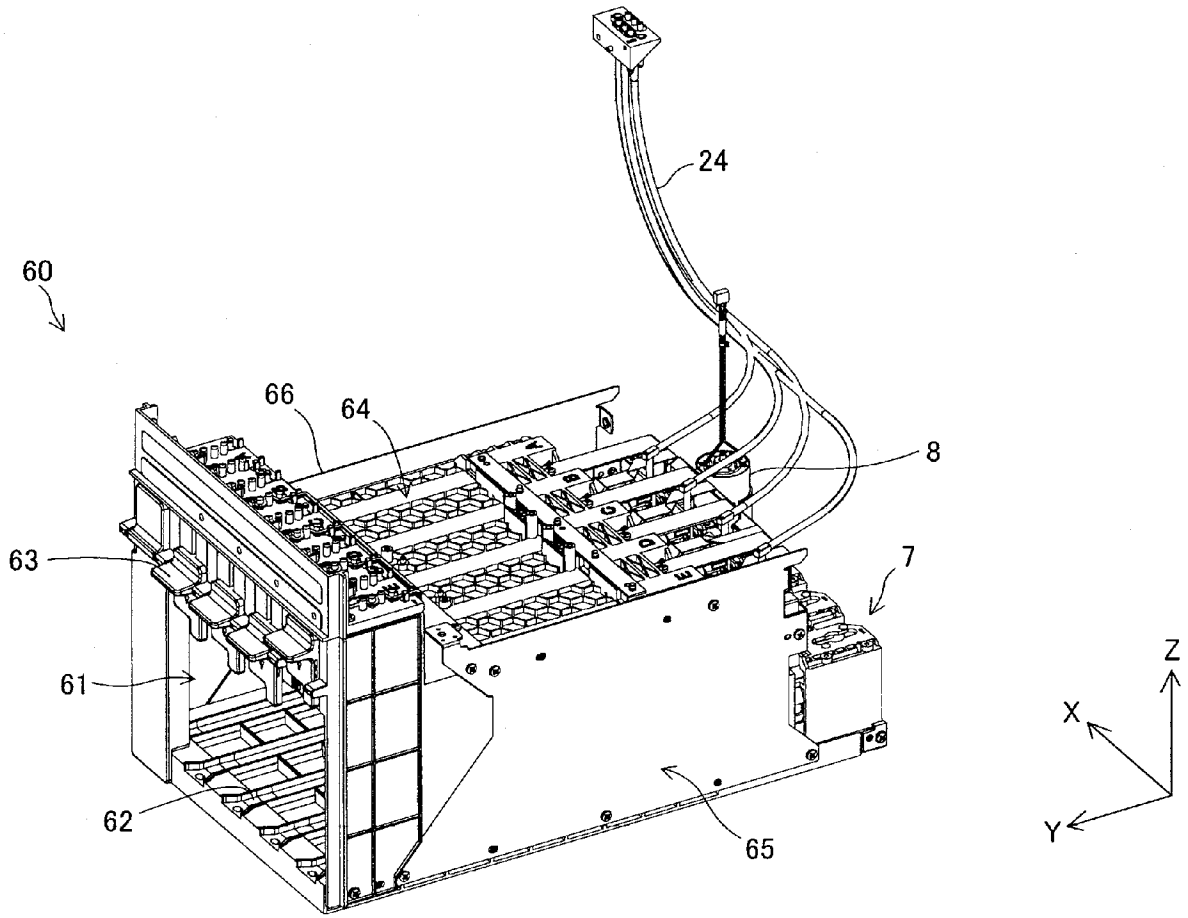
FIG. 2 is a detailed external perspective view of a cartridge holder.

FIG. 2 is a detailed external perspective view of the cartridge holder 60. Slots 61 into which the cartridges 40 are inserted from the +Y-axis direction toward the −Y-axis direction are provided to the cartridge holder 60. A guide groove 62 is provided to the slot 61 for every cartridge 40, on the surface of the +Z-axis direction side (the upper surface) and the surface of the −Z-axis direction side (the base surface), along the Y-axis direction. Rail sections 413, 414 (FIG. 3) provided to the surface of the +Z-axis direction side (the upper surface) and the surface of the −Z-axis direction side (the base surface) of the cartridges 40, respectively, slide while fitted into each of the guide grooves 62 during the loading of the cartridges 40.

Fixing levers 63 for fixing the cartridges 40 are provided for every cartridge 40 to an upper part of the entrance of the slot 61. The fixing levers 63, when slid in the -Z-axis direction, fit into a handle 47 (FIG. 3) of the cartridges 40, thus regulating the movement of the cartridges 40 in the +Y-axis direction.

Pump units 7 for sucking the ink from the cartridges 40 are provided for every cartridge 40 to a −Y-axis direction end part of the cartridge holder 60. A pump drive motor 8 for driving the pump units 7 is connected to each of the pump units 7. The ink sucked in by the pump units 7 is supplied to the spray head 20 through the ink tubes 24.

Figure 3:
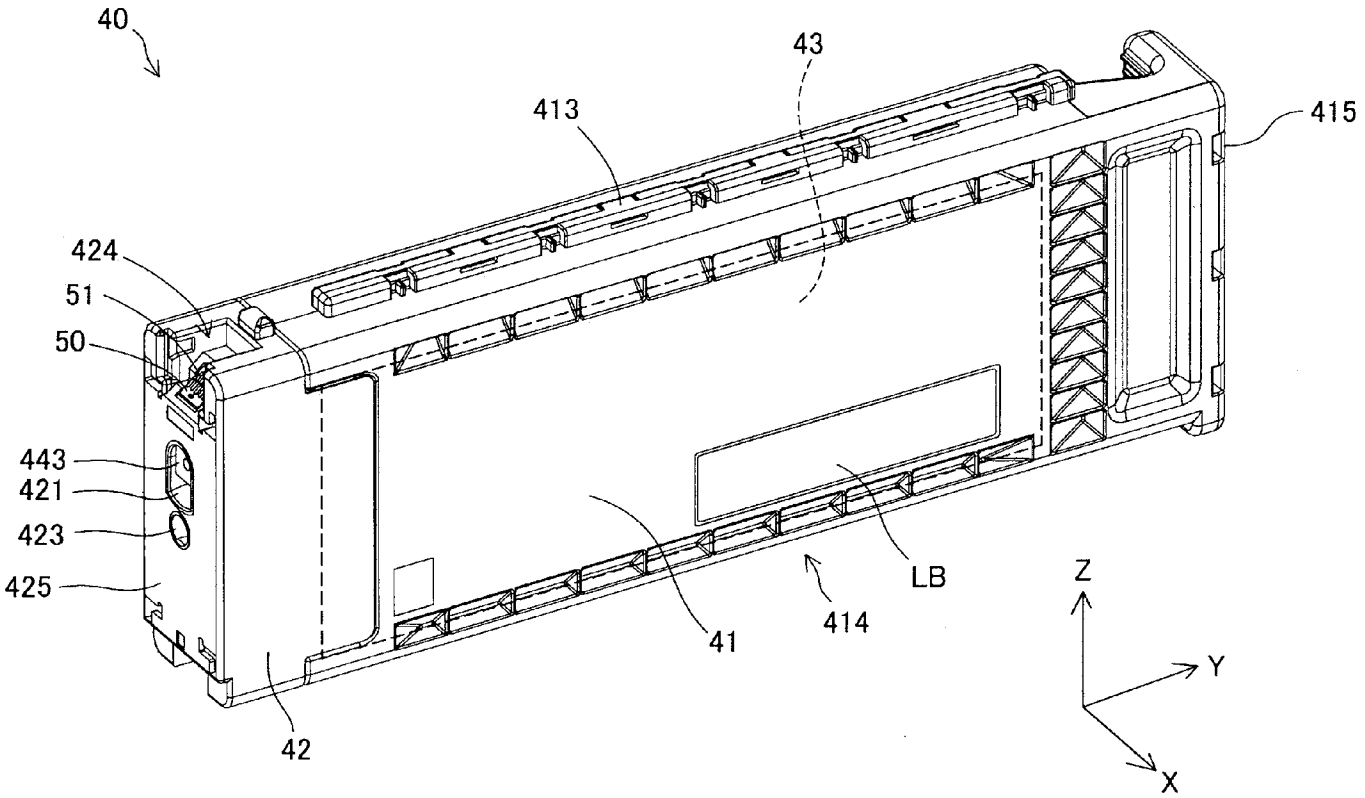
FIG. 3 is an external perspective view of a cartridge.
Figure 4:
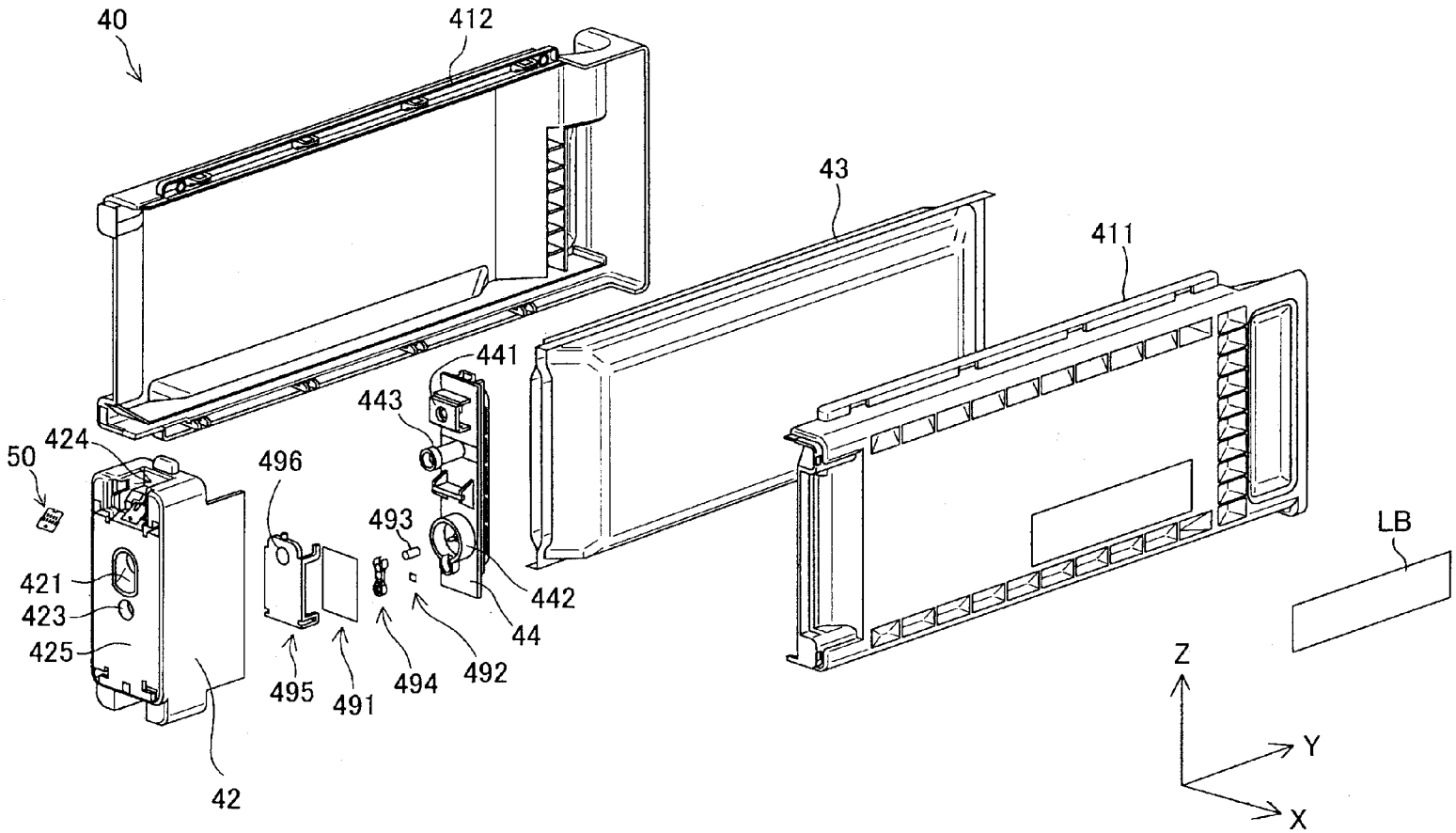
FIG. 4 is an exploded perspective view of a cartridge.

FIG. 3 is an external perspective view of a cartridge 40. FIG. 4 is an exploded perspective view of the cartridge 40. The cartridge 40 is provided with a case member 41, a covering member 42, a flexible ink pack 43, and a liquid flow passage member 44.

The case member 41 is provided with a right case 411 and a left case 412. A handle or grip 415 is provided to an end part of the case member 41 in the +Y-axis direction. A label LB is pasted onto the surface of the right case 411 on the +X-axis direction side. The rail sections 413, 414 are formed on the case member 41, on the surface in the +Z-axis direction and the surface in the −Z-axis direction, along the Y-axis direction. The rail sections 413, 414 are fitted into the guide groove 62 of the cartridge holder 60 illustrated in FIG. 2 when the cartridge 40 is being mounted into the cartridge holder 60.

The liquid flow passage member 44 is a member for supplying ink with which the ink pack 43 is filled to the print apparatus 10. The liquid flow passage member 44 is fixed to an opening section in the −Y-axis direction of the ink pack 43, which is formed in a pouch shape. The liquid flow passage member 44 is accommodated in the interior of the covering member 42 when the covering member 42 has been attached to the opening section of the −Y-axis direction end part of the case member 41. The ink pack 43 is accommodated between the right case 411 and the left case 412, which constitute the case member 41.

An ink filling port 441, an ink supply pipe 443, and an ink detection chamber 442 are arranged in the stated order toward the −Z-axis direction from the end part in the +Z-axis direction on the surface of the −Y-axis direction side of the liquid flow passage member 44 (the surface opposite to the ink pack 43). The ink supply pipe 443 is equivalent to the "liquid supply unit" of the present application. The ink filling port 441, which is in communication with the interior of the ink pack 43, is provided in order for the inside of the ink pack 43 to be filled with ink After the inside of the ink pack 43 is filled with ink that has passed through the ink filling port 441, the ink filling port 441 is sealed.

The ink detection chamber 442, which communicates with the interior of the ink pack 43, is used in order to detect the state of ink remaining inside the ink pack 43. A flexible film member 491 is provided to the surface on the −Y-axis direction side of the ink detection chamber 442. A spring 493 is disposed between the film member 491 and a base surface of the ink detection chamber 442 (the inside of the +Y-axis direction side), with a pressure-accepting member 494 interposed therebetween. Ink flows into the ink detection chamber from inside the ink pack 43 by passing through a check valve 492. A plate-shaped sensor lever 495 is disposed on the −Y-axis direction side of the film member 491. An end part of the sensor lever 495 in the −Z-axis direction is rotatably fixed to the liquid film passage member 44. A contact section 496 is provided to the front surface on the −Y-axis direction side of the end part of the sensor lever 495 in the +Z-axis direction. An end part in the +Y-axis direction of a rod member 720 (FIG. 6) provided on the print apparatus 10 side abuts against the contact section 496 by passing through a sensor hole 423 provided to the covering member 42. In a case where, for example, a predetermined amount of ink or more is present in the ink pack 43, then the combined sum of the pressure of the ink inside the ink detection chamber 44 (the pressure inside the ink pack) and the force of the spring 493 is greater than the pressing force of the rod member 720 in the +Y-axis direction. For this reason, the film member 491, the sensor lever 495, and the rod member 720 are displaced in the −Y-axis direction. On the other hand, in a case where there is less than the predetermined amount of ink (a case of the end of the ink), the combined sum of the pressure of the ink inside the ink detection chamber 44 (the pressure inside the ink pack) and the force of the spring 493 is less than the pressing force of the rod member 720 in the +Y-axis direction. For this reason, the film member 491, the sensor lever 495, and the rod member 720 are displaced in the +Y-axis direction.

The ink supply pipe 443 is used in order to supply the ink to the print apparatus 10. The ink supply pipe 443 is in communication with the ink detection chamber 442 by a flow passage formed in the interior of the liquid flow passage member 44. For this reason, ink passes through the ink detection chamber 442 from inside the ink pack 43 and into the ink supply pipe 443. In the present embodiment, the cartridge 40 is provided with the ink detection chamber 442, but the configuration need not be provided with the ink detection chamber 442. In such a case, the ink supply pipe 443 would be in direct communication with the inside of the ink pack 43.

A base plate 50, a supply pipe hole 421, and the sensor hole 423 are arranged on the covering member 42 in the stated order toward the −Z-axis direction from the end part in the +Z-axis direction, on an abutting surface 425 on the −Y-axis direction side that abuts against the print apparatus 10 side. The supply pipe hole 421 is equivalent to the "indent" of the present application.

The base plate 50 is attached to a recess 424 provided to the end part of the covering member 42 in the +Z-axis direction, so as to face upward at an incline. A memory device (not shown) is installed on the back surface of the base plate 50 (the surface on the +Y-axis direction side). A plurality of terminals 51 (FIG. 3) electrically connected to the memory device are provided to the front surface of the base plate 50 (the surface on the −Y-axis direction side). When the cartridge 40 is mounted onto the cartridge holder 60, a terminal 712 (FIG. 6) on the print apparatus 10 side provided to the cartridge holder 60 comes into contact with the terminals 51 of the front surface of the base plate 50. In so doing, the control unit 16 of the print apparatus 10 is then able to access the memory device provided to the cartridge 40.

The ink supply pipe 443 provided to the liquid flow passage member 44 is exposed to the inside of the supply pipe hole 421. The supply pipe hole 421 is indented toward the +Y-axis direction, and has a predetermined depth. An inner wall below (in the -Z-axis direction of) the supply pipe hole 421 is inclined so as to rise in the +Z-axis direction while proceeding in the +Y-axis direction from the −Y-axis direction. To offer a different description, the inner wall below (in the −Z-axis direction of) the supply pipe hole 421 is inclined so as to go down in the −Z-axis direction while proceeding in the −Y-axis direction from the +Y-axis direction. The supply pipe hole 421 is positioned vertically above the contact section 496 of the sensor lever 495.

The rod member 720 (FIG. 6) provided to the print apparatus 10 is inserted into the sensor hole 423. As described above, the end part of the rod member 720 in the +Y-axis direction abuts against the contact section 406 of the sensor lever 495 provided to the liquid flow passage member 44 by passing through the sensor hole 423 when the cartridge 40 is mounted onto the cartridge holder 60.

Figure 5:
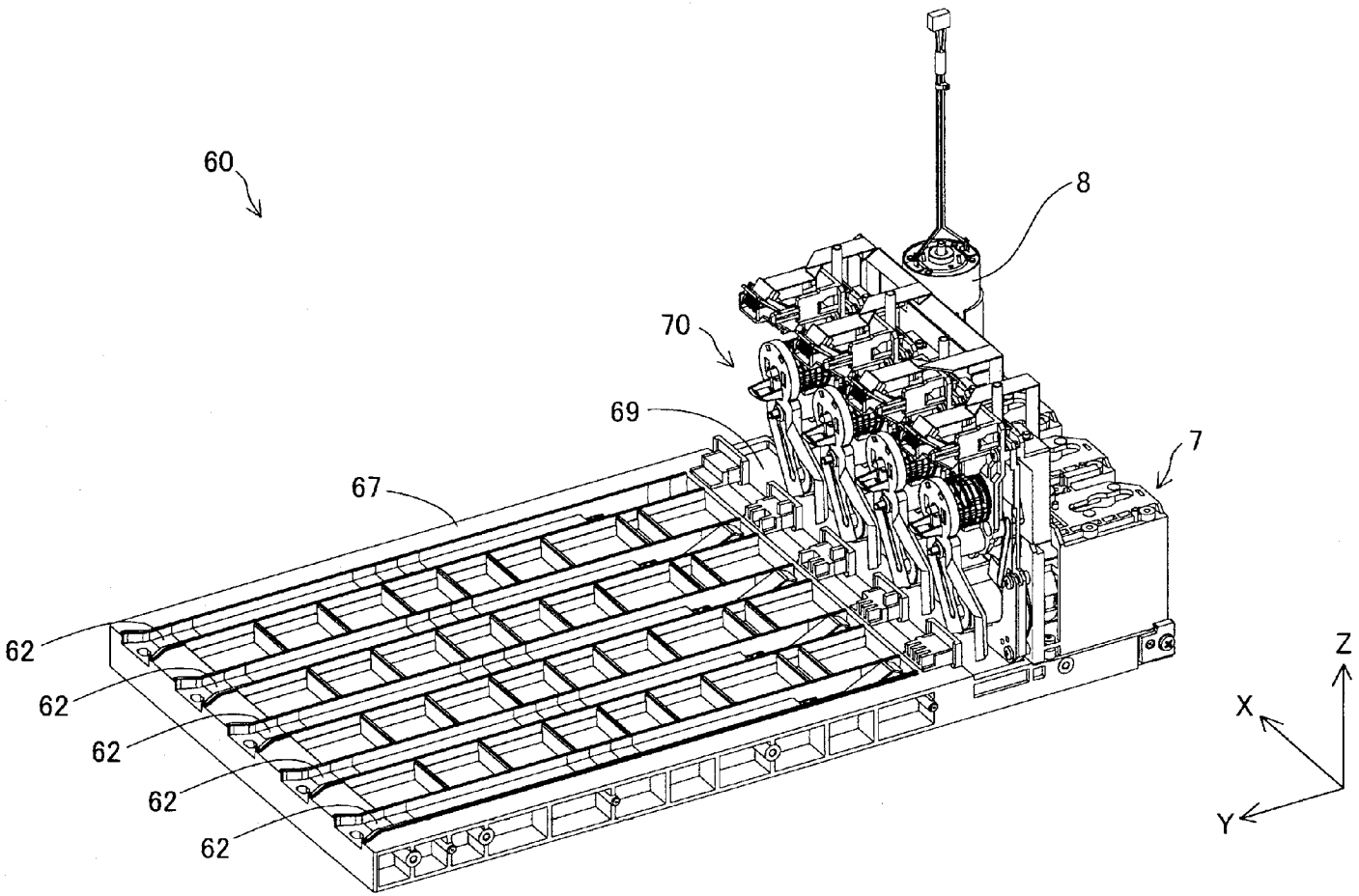
FIG. 5 is a perspective view illustrating an internal structure of a cartridge holder.

FIG. 5 is a perspective view illustrating the internal structure of the cartridge holder 60. FIG. 5 illustrates the condition when an upper covering 64 and side plates 65, 66 of the cartridge holder 60 have been removed, as seen from the perspective view illustrated in FIG. 2. As is illustrated in FIG. 5, an ink delivery mechanism 70 is erected for every cartridge 40 in the interior of the cartridge holder 60, so as to be adjacent to the end part in the −Y-axis direction of the guide groove 62 provided on a bottom plate 67. The pump units 7 are connected to each of the ink delivery mechanisms 70. An ink absorption member 69 is disposed at a bottom part of the ink delivery mechanisms 70. The ink absorption member 69 is equivalent to the "first absorbent material" of the present application.

Figure 7:
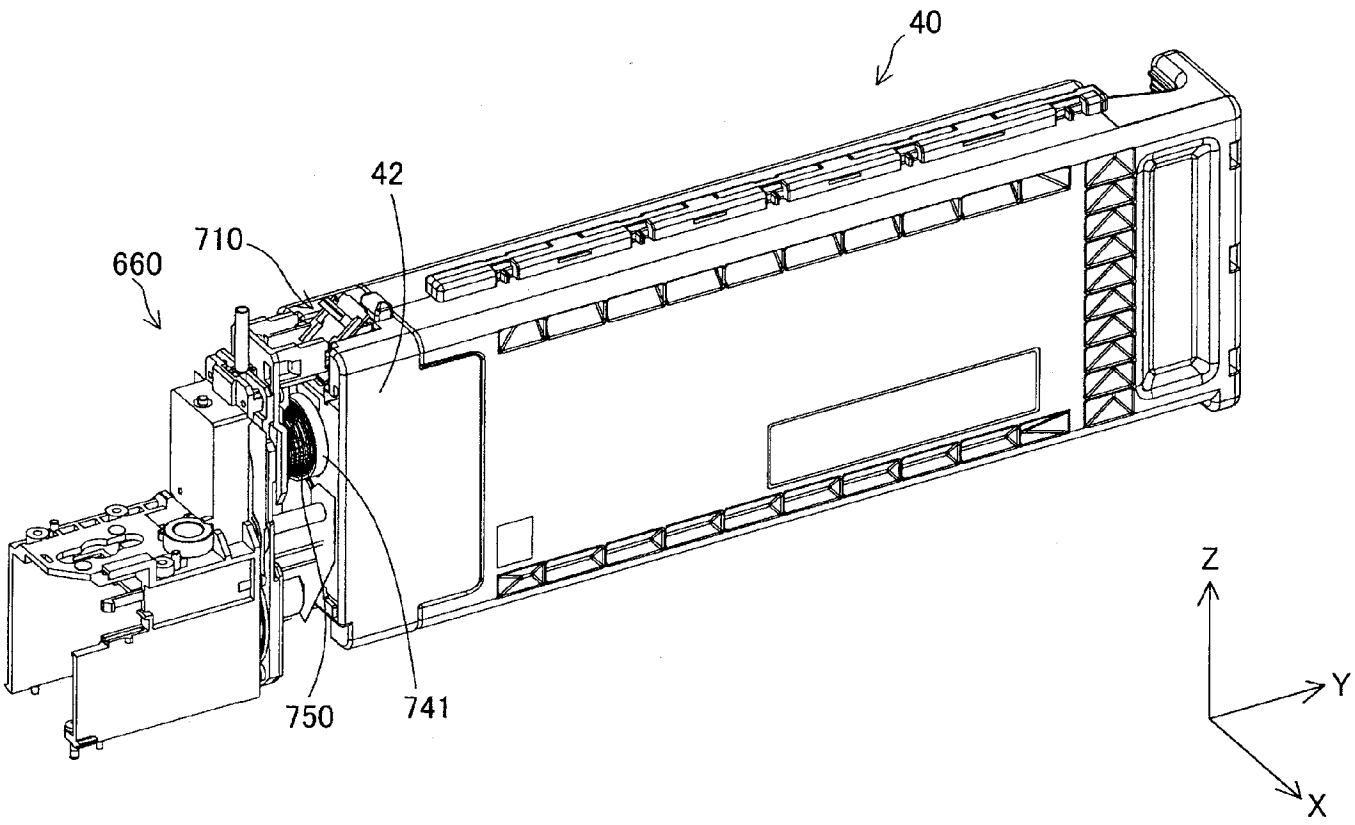
FIG. 7 is a perspective view illustrating a state where a cartridge has been brought into contact with an ink delivery mechanism.

FIG. 6 is a perspective view illustrating a detailed view of the ink delivery mechanism 70. FIG. 7 is a perspective view illustrating a state where the cartridge 40 has been connected to the ink delivery mechanism 70. As illustrated in FIG. 6, the ink delivery mechanism 70 is provided with a base plate contact section 710, the rod member 720, the ink delivery needle 730, and an ink accepting member 740. The ink delivery needle 730 is equivalent to the "liquid delivery unit" of the present application.

The base plate contact section 710 is provided to the end part of the ink delivery mechanism 70 in the +Z-axis direction. The base plate contact section 710 has the terminal 712, which is in electrical contact with the terminal 51 on the base plate 50 provided to the cartridge 40 when the cartridge 40 has been mounted into the cartridge holder 60 (see FIG. 7). A connector 714 is provided to the back surface side of the terminal 712. The connector 714 is connected to the control unit 16 through a predetermined cable.

The rod member 720 is provided to substantially the middle part of the ink delivery mechanism 70 in the Z-axis direction. The end part of the rod member 720 in the +Y-axis direction is inserted into the sensor hole 423 and comes into contact with the sensor lever 495, which is provided to an ink supply member 480, when the cartridge 40 has been mounted into the cartridge holder 60. The end part of the rod member 720 on the −Y-axis direction side is positioned on the inside of the ink delivery mechanism 70, and the position thereof is detected by a photo sensor 760 (FIGS. 9, 10) provided to the inside of the ink delivery mechanism 70. The control unit 16 detects the state of ink remaining inside the cartridge 40 in accordance with a change in the position of the end part of the rod member 720 in the −Y-axis direction, as detected by the photo sensor 760.

Figure 11:
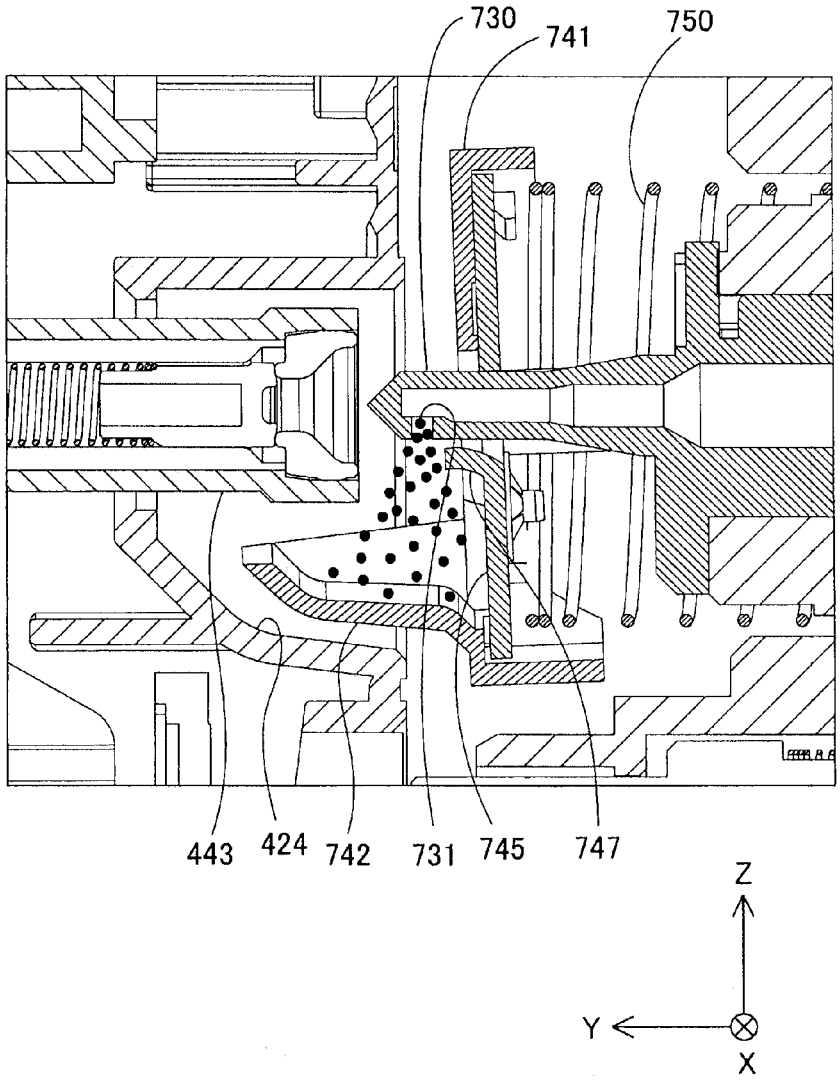
FIG. 11 is a ZY cross-sectional view of the vicinity of a collecting pan when a cartridge is removed from a cartridge holder.

The ink delivery needle 730 is provided between the base plate contact section 710 and the rod member 720, in the Z-axis direction. The ink delivery needle 730 is inserted into (connected to) the ink supply pipe 443 provided to the cartridge 40 when the cartridge 40 is mounted into the cartridge holder 60. An ink delivery port 731 is provided to a lower part of a distal end of the ink delivery needle 730 (the end part in the +Y-axis direction) (FIG. 11). The ink inside the cartridge 40 is delivered to the print apparatus 10 by passing through the ink delivery port 731.

Figure 8:
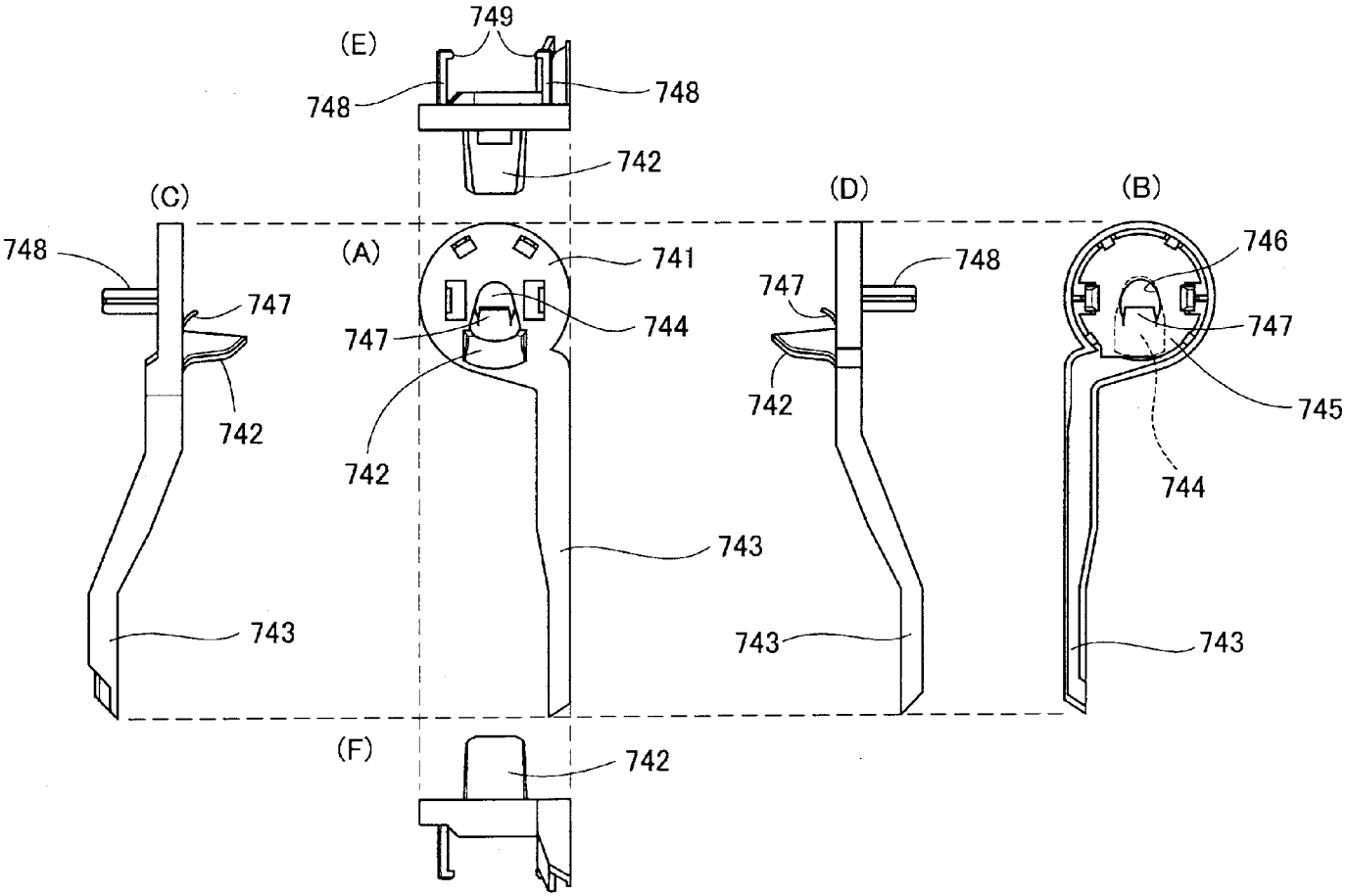
FIG. 8 is a perspective view of an ink accepting member.

FIG. 8 is a perspective view of the ink accepting member 740. FIGS. 8A, 8B, 8C, 8D, 8E, and 8F illustrate the surface of the +Y-axis direction side, the surface of the -Y-axis direction side, the surface of the +X-axis direction side, the surface of the −X-axis direction side, the surface of the +Z-axis direction side, and the surface of the −Z-axis direction side, respectively, of the ink accepting member 740.

The ink accepting member 740 has a substantially circular abutting section 741, a collecting pan 742, and a gutter member 743, which are integrally formed together to thereby constitute the ink accepting member. An opening 744 spanning a position of (the end part in the −Y-axis direction) of a proximal end of the accepting pan 742, from the center of the abutting section 741 toward the −Z-axis direction, is provided to the abutting section 741. The ink delivery needle 730 protrudes out from the opening 744 (FIG. 6). The accepting pan 742 is provided to a bottom part of the opening 744 on the +Y-axis direction side of the abutting section 741. The gutter member 743, which extends downward from the abutting section 741, is provided to the bottom part of the abutting section 741. The gutter member 743 is bent toward the −X-axis direction side, in order to avoid the rod member 720 which is positioned below the ink delivery needle 730. The surface of the -Y-axis direction side of the gutter member 743 is opened, and the XY cross-section thereof has the shape of the letter "U". In the present embodiment the back surfaces of the abutting section 741 and the gutter member 743 (the surfaces of the −Y-axis direction sides) are opened, but may also be closed off by a covering or the like so that the interior becomes a hollow. The accepting pan 742 is equivalent to the "liquid accepting unit" of the present application.

A flat, substantially circular ink absorbent material is disposed on the surface of the −Y-axis direction side of the abutting section 741. The ink absorbent material 745 is equivalent to the "second absorbent material" of the present application.

An opening 746 is provided to the middle of the ink absorbent material 745, and a tongue-shaped wiping part 747 is formed on a bottom part of the opening 746. The wiping part 747 is in contact with the bottom part of the ink delivery needle 730 and wipes off ink sticking to the bottom part of the ink delivery needle 730. The wiping part 747 is positioned closer to the −Y-axis direction side than the ink delivery port 731 of the ink delivery needle 730, so as not to come into contact with the ink delivery port 731. The bottom part of the ink absorbent material 745 is in contact with the inner wall of the proximal end (the end part of the −Y-axis direction) of the accepting pan 742. The ink that is wiped off by the wiping part 747 follows the gutter member 743 and is absorbed by the ink absorbent material 69 disposed on the bottom part of the ink delivery mechanism 70.

The width of the accepting pan 742 in the X-axis direction gradually increases going toward the −Y-axis direction side from the +Y-axis direction side when seen from the upper surface (+Z-axis direction) side, as is illustrated in FIG. 8E. As is illustrated in FIGS. 8C and 8D, the inner wall of the bottom section of the accepting pan 742 is configured so as to descend vertically downward (in the −Z-axis direction) going toward the -Y-axis direction from the +Y-axis direction. The accepting pan 742 is entered into the supply pipe hole 421 provided to the covering member 42 of the cartridge 40 (FIG. 11) when the cartridge 40 is being mounted into the cartridge holder 60. For this reason, the incline of the bottom part of the supply pipe hole 421 and the incline of the bottom part of the accepting pan 742 are shaped so as to be substantially analogous. When the accepting pan 742 is inserted into the supply pipe hole 421, the accepting pan 742 is disposed below the end surface of the ink supply pipe 443 in the -Y-axis direction. In the present embodiment, the width of the accepting pan 742 in the X-axis direction gradually increases going toward the -Y-axis direction side from the +Y-axis direction side when seen from the upper surface (+Z-axis direction) side, as is illustrated in FIG. 8E, but the width in the X-direction may also be uniform across the Y-axis direction.

The ink accepting member 740 is attached to the ink delivery mechanism 70 with a spring 750 interposed therebetween. The spring 750 is equivalent to the "urging member" of the present application. The ink accepting member 740 is urged in the +Y-axis direction by the spring 750 when in a state where the cartridge 40 has been attached to the cartridge holder 60. The position of attachment of the ink accepting member 740 in the Y-axis direction in the state where the cartridge 40 has been mounted into the cartridge holder 60 is positioned by a hook 749 of the distal end of an arm part 748 (FIG. 8) provided to the surface of the −Y-axis direction side of the ink accepting member 740 so as to face the −Y-axis direction, the hook locking into a predetermined engagement part of the ink delivery mechanism 70.

Figure 9:
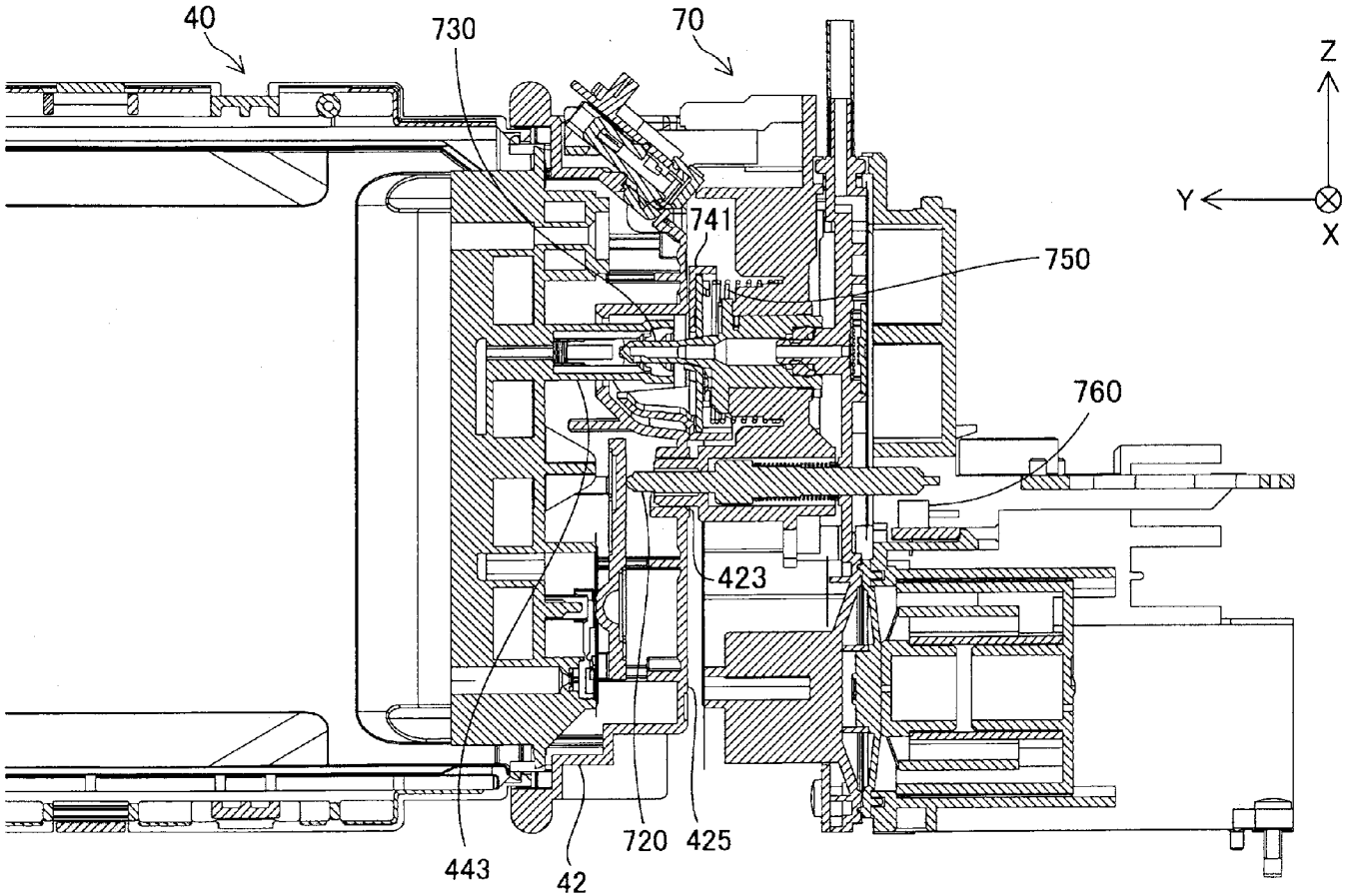
FIG. 9 is a ZY cross-sectional view at a connecting portion connecting an ink delivery mechanism and a cartridge when the cartridge has been mounted to a cartridge holder.
Figure 10:
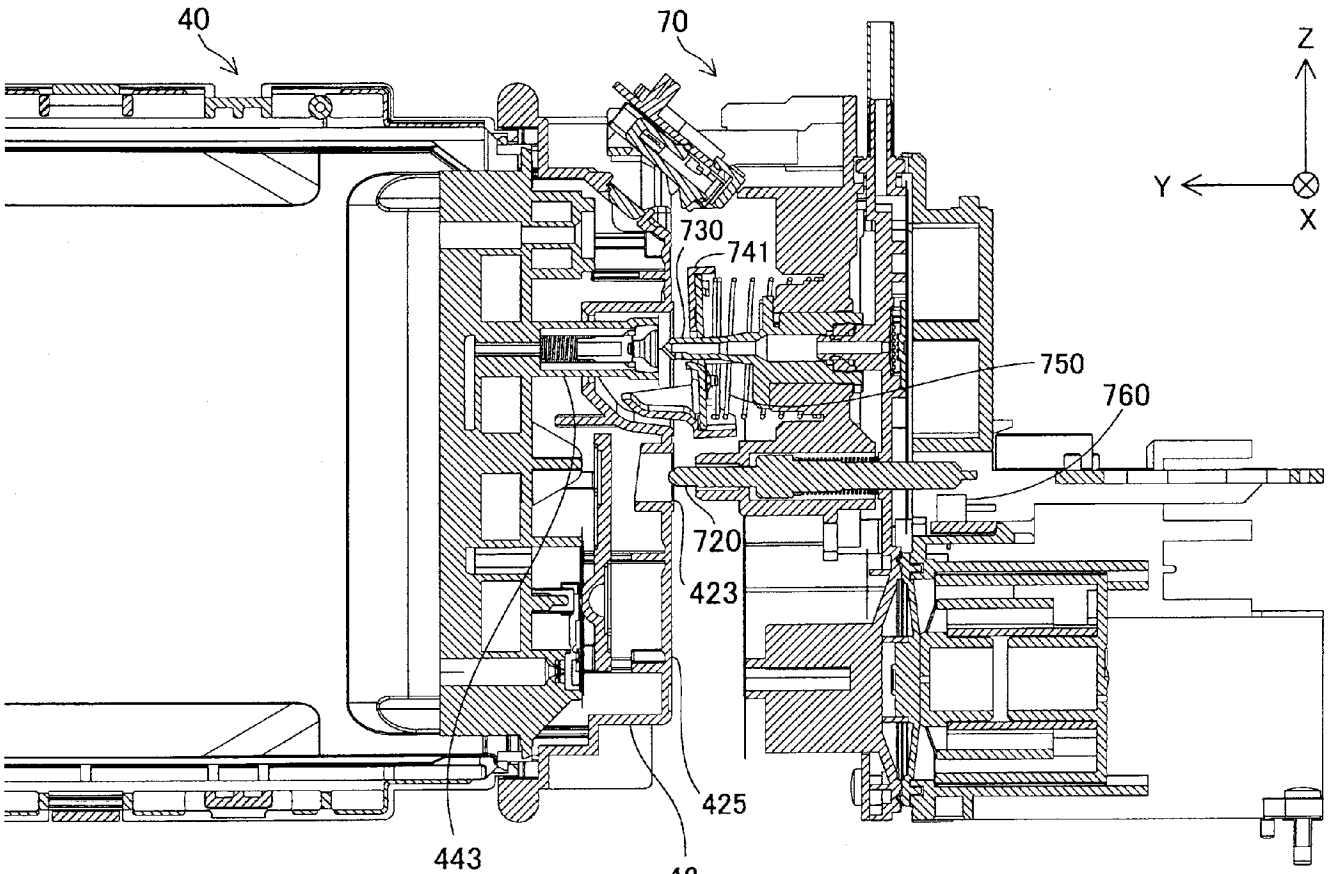
FIG. 10 is a ZY cross-sectional view at a connecting portion connecting an ink delivery mechanism and a cartridge when the cartridge is removed from a cartridge holder.

FIG. 9 is a ZY cross-sectional view at a connecting portion connecting the ink delivery mechanism 70 and the cartridge 40 when the cartridge 40 has been mounted into the cartridge holder 60. FIG. 10 is a ZY cross-sectional view at the connecting portion connecting the ink delivery mechanism 70 and the cartridge 40 when the cartridge 40 is removed from the cartridge holder 60. FIG. 11 is a ZY cross-sectional view of the vicinity of the accepting pan 742 when the cartridge 40 is removed from the cartridge holder 60.

In a case where, as is illustrated in FIG. 9, the cartridge 40 has been mounted into the cartridge holder 60, then the abutting section 741 of the ink accepting member 740 abuts against the abutting surface 425 of the covering member 42 of the cartridge 40, and the entirety of the ink accepting member 740 is urged toward the −Y-axis direction side (the ink delivery mechanism 70 side) by the cartridge 40. In this state, the ink delivery needle 730 protrudes relatively outward in the +Y-axis direction from the abutting section 741, and is inserted deep into the ink supply pipe 443 of the cartridge 40.

When, as is illustrated in FIG. 10, the cartridge 40 is removed from the cartridge holder 60, the abutting section 741 of the ink accepting member 740 is urged in the +Y-axis direction by the spring 750 simultaneously with the ink delivery needle 730 being pulled out from the ink supply tube 443. For this reason, the accepting pan 742 moves in the +Y-axis direction so as to follow the movement of the cartridge 40. The position of the ink delivery needle 730 is fixed to the ink delivery mechanism 70, and therefore the distal end (the end part in the +Y-axis direction) of the accepting pan 742 will move so as to draw apart toward the +Y-axis direction side from the ink delivery port 731.

When, as is illustrated in FIG. 11, the distal end of the accepting pan 742 moves so as to draw apart toward the +Y-axis direction side from the ink delivery port 731, then it is possible for the accepting pan 742 to easily catch ink dripping vertically downward from the ink delivery port 731 or ink sprayed vertically downward due to the residual pressure inside the ink delivery needle 730. When the ink is caught by the accepting pan 742, the ink passes through the inside of the opening 744 of the ink accepting member 740 (FIG. 8) and the inside of the ink absorbent material and moves to the back surface (the surface in the −Y-axis direction) of the abutting section 741, follows the gutter member 743, and flows downward (in the −Z-axis direction). The ink that has flowed through the gutter member 743 drips down from the end part below (in the −Z-axis direction of) the gutter member 743 into the ink absorbent material 69 (FIG. 5) disposed within the bottom plate 67 of the cartridge holder 60, and is absorbed by the ink absorbent material 69.

Thus, in the present embodiment, when the cartridge 40 has been mounted into the cartridge holder 60, because the accepting pan 742 of the ink accepting member 740 is disposed vertically below the ink supply pipe 443 of the cartridge 40, even in a case where ink dripping takes place when the cartridge 40 is removed, the dripping ink can be favorably caught and handled. Also, because the gutter member 743 is formed on the ink accepting member 740, it is possible to reliably cause the ink absorbent material 69 to absorb the ink that has been caught by the accepting pan 74. As a result, it is possible to curb sullying around the contact section between the ink delivery needle 730 and the ink supply pipe 443.

In the present embodiment, the accepting pan 742 is configured so that the inner wall of the bottom section descends vertically downward with respect to the mounting direction (−Y-axis direction) in which the cartridge 40 is mounted into the print apparatus 10. For this reason, the ink that has been caught by the accepting pan 742 can be made to flow toward the print apparatus 10 side, i.e., toward the proximal end side of the accepting pan 742, and thus it is possible to curb the leakage of ink from the distal end of the accepting pan 742. Also, the accepting pan 742 is configured so that the width thereof in the X-axis direction widens going toward the −Y-axis direction, and can thus easily be entered into the supply pipe hole 421 provided to the abutting surface 425 of the cartridge 40.

In the present embodiment, during the removal of the cartridge 40, the urging of the spring 750 causes the ink accepting member 740 to move toward the +Y-axis direction. For this reason, in association with this movement, the wiping part 747 of the ink absorbent material 745 attached to the ink accepting member 740 slides on the lower part of the ink delivery needle 730, and wipes away ink that has stuck to the lower part of the ink delivery needle 730. It is accordingly possible to curb sullying around the ink delivery needle 730 caused by the ink.

In the present embodiment, because the accepting pan 742 is disposed vertically above the rod member 720, it is possible to curb sticking of the ink to the rod member 720, which moves along the Y-axis direction. It is accordingly possible to prevent the rod member 720 from sticking fast due to the sticking of the ink.

Further, in the present embodiment, the wiping part 747 for wiping on the ink delivery needle 730 is disposed so as to be positioned closer to the −Y-axis direction side than the ink delivery port 731, which is provided to the lower part of the ink delivery needle 730, even in a case where the abutting section 741 has moved as far as possible in the +Y-axis direction. For this reason, even though waste may be generated from the wiping part 747, blocking off of the ink delivery port 731 by the waste is curbed. It is accordingly possible to prevent impurities from flowing into the print apparatus 10 during suction of the ink from the cartridge 40.

One embodiment of the present invention has been described above; however, the present invention is in no way limited to the embodiment of such description, and can be implemented in a variety of modes within a scope not departing from the spirit thereof For example, modifications such as the following are possible.

FIRST MODIFICATION EXAMPLE

Figure 12:
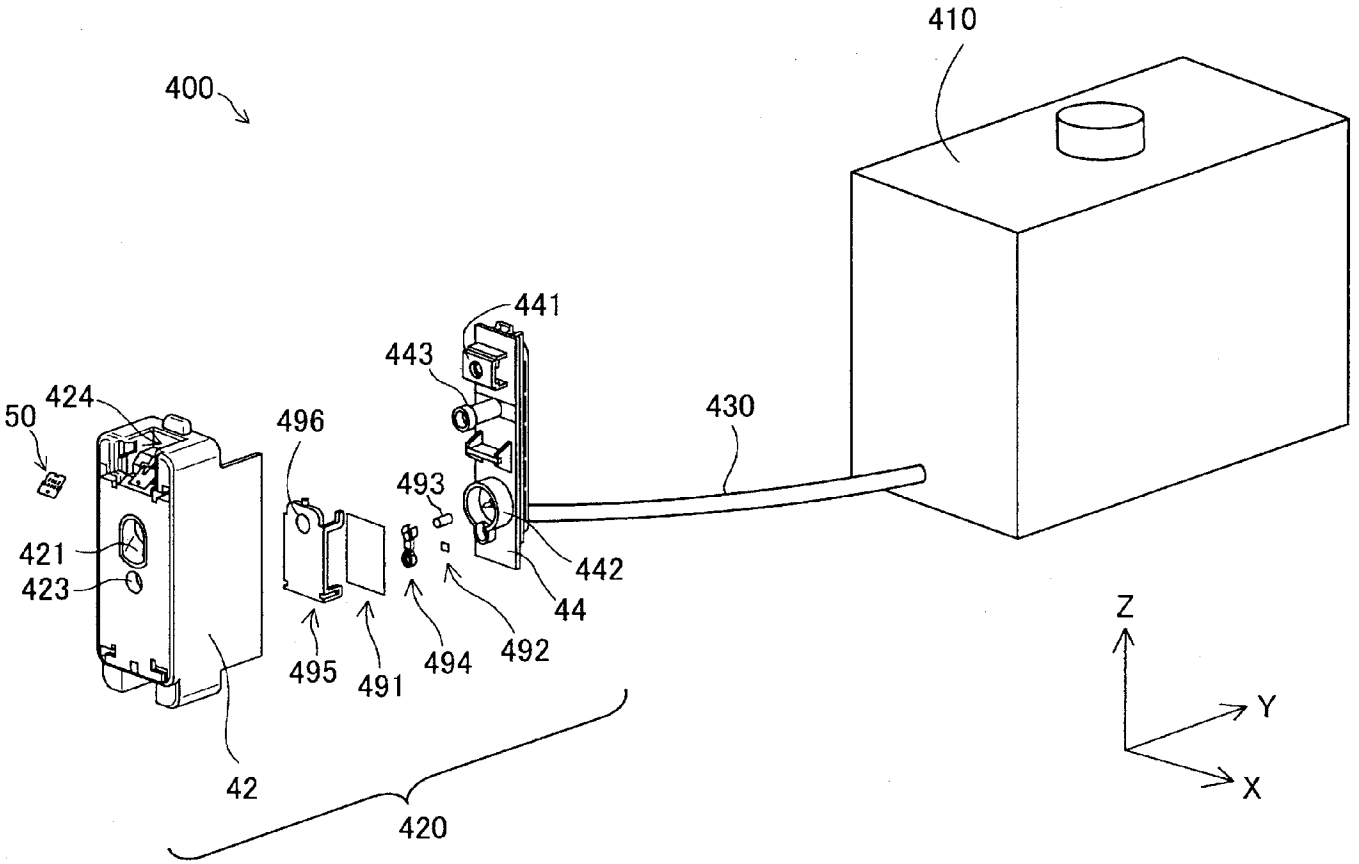
FIG. 12 is an exploded perspective view of an ink supply system serving as a modification example of a cartridge.

FIG. 12 is an exploded perspective view of an ink supply system 400 serving as a modification example of the cartridge 40. In the embodiment described above, the cartridge 40 was used to supply the ink to the print apparatus 10. By contrast, in the present modification example, the ink is supplied to the print apparatus 10 from a large-capacity ink tank 410. The ink supply system 400 is provided with the covering member 42, the liquid flow passage member 44, and the ink tank 410 which serves as a liquid storage unit. The covering member 42 and the liquid flow passage member 44 are identical to those in the embodiment described above. The ink tank 410 and the liquid flow passage member 44 are connected together via a tube 430. The ink tank 410 is filled with the ink, and the ink passes through the tube 430 and flows into the ink detection chamber 442 of the liquid flow passage member 44. In the present modification example, the ink detection chamber 442 is not essential; rather, the tube 430 may be connected directly to the ink supply tube 443.

In the present modification example, the covering member 42 and the liquid flow passage member 44 function as an adapter 420 for supplying ink to the print apparatus 10 from the ink tank 410. For this reason, when the adapter 420 is mounted into the cartridge holder 60 of the print apparatus 10, it is possible for a large amount of ink to be supplied to the print apparatus 10 from the high-capacity ink tank 410. Further, in the present modification example, because the liquid flow passage member 44 and the ink tank 410 are connected together by the tube 430, the print apparatus 10 and the ink tank 410 can be disposed as separate locations.

In the present modification example, the covering member 42 was understood to be identical to that in the embodiment described above, but in order to facilitate mounting onto the slot 61, a box-shaped member may also be connected to the end part of the covering member 42 in the +Y-axis direction. Also, the covering member 42 itself may be extended in the +Y-axis direction.

SECOND MODIFICATION EXAMPLE

In the embodiment described above, the ink accepting member 740 was moved toward the +Y-axis direction by the urging of the spring 750 during the removal of the cartridge 40. By contrast, the spring 750 may be omitted, the ink accept member 740 then being fixed to the ink delivery mechanism 70 so as not to move. The rod member 720 and/or the ink detection chamber 442 may also be omitted. In addition, the gutter member 743 may be formed of, for example, a tube.

THIRD MODIFICATION EXAMPLE

The present invention is not limited to a print apparatus or cartridge, and can also be applied to any desired liquid spray apparatus for spraying a liquid other thank ink, as well as to a liquid accommodation container therefor. For example, the present invention can be applied to a variety of liquid spray apparatuses and liquid accommodation containers therefor as follows.

(1) An image recording apparatus, such as a facsimile (2) A color material spray apparatus used to produce a color filter for an image display device, such as a liquid crystal display (3) An electrode material spray apparatus used to form an electrode such as for an organic electroluminescence (EL) display or a field emission display (FED)

(4) A liquid spray apparatus for spraying a liquid including a bio-organic material used to produce a bio-chip (5) A sample spray apparatus that serves as a precision pipette (6) An apparatus for spraying lubricating oil (7) An apparatus for spraying a resin solution (8) A liquid spray apparatus for spraying lubricating oil at pinpoints onto precision machinery of a timepiece, camera, or the like (9) A liquid spray apparatus for spraying a substrate with a transparent resin solution, such as an ultraviolet-ray-curable resin solution, in order to form a hemispherical microlens (an optical lens) or the like to be used in an optical communication element or the like

(10) A liquid spray apparatus for spraying an acidic or alkaline etching solution in order to etch a substrate or the like

(11) A liquid spray apparatus provided with a liquid spray head for ejecting small amounts of liquid droplets of any desired liquid The phrase "liquid droplets" refers to the state of a liquid that is ejected from a liquid spray apparatus, and is understood to also include a liquid that leaves a particulate, tear-shaped, or filamentous trail. The phrase "liquid" as stated herein should be such a material that the liquid spray apparatus is able to spray the material.

For example, the "liquid" should be a material that is in a state when a substance is a liquid phase, and the phrase "liquid" also includes highly- or poorly-viscous liquid-state materials, as well as sols, gel waters, and other such liquid-state materials as inorganic solvents, organic solvents, solutions, liquid-state resins, and liquid-state metals (metallic melts). The phrase "liquid" also includes not only a liquid as one state of a substance, but also particles of functional materials made from solids, such as pigments or metal particles, that have been dissolved, dispersed, or mixed into a solution, and the like. Representative examples of liquids include ink, as was described in the embodiment above, as well as liquid crystal and the like. Herein, the term "ink" comprises a variety of compositions in the form of a liquid, such as general water-soluble ink and oil-soluble ink as well as gel ink, hot melt ink, and the like

GENERAL INTERPRETATION OF TERMS

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Finally, terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. A liquid consumption apparatus onto which a liquid supply member is mounted, the liquid consumption apparatus comprising:

a liquid delivery unit provided on the liquid consumption apparatus, and configured to deliver a liquid from the liquid supply member into the liquid consumption apparatus;

a liquid accepting unit provided on the liquid consumption apparatus below the liquid delivery unit for catching inadvertently spilled and/or sprayed liquid from the liquid delivery unit; and an abutting section having an abutting surface that abuts against the liquid supply member, wherein, in a state where the abutting surface and the liquid supply member abut against each other, the liquid accepting unit protrudes out further toward the liquid supply member than the abutting surface of the abutting section.

2. The liquid consumption apparatus according to claim 1, further comprising a first absorbent agent configured to absorb the liquid, and a member configured to guide the liquid from the liquid accepting unit to the first absorbent material.

3. The liquid consumption apparatus according to claim 1, wherein a bottom section of the liquid accepting unit is inclined so that the liquid flows toward the liquid consumption apparatus side.

4. The liquid consumption apparatus according to claim 1, wherein a width of the liquid accepting unit is configured so as to become wider going toward a mounting direction in which the liquid supply member is mounted onto the liquid consumption apparatus.

5. The liquid consumption apparatus according to claim 1, further comprising a member having one end and another end, wherein, in a state the liquid supply member is mounted on the liquid consumption apparatus, the one end of the member abuts against the liquid supply member and the other end of the member is detected in the interior of the liquid consumption apparatus, the liquid accepting unit being provided vertically above the member to be detected.

6. The liquid consumption apparatus according to claim 1, further comprising an urging member configured to urge the liquid accepting unit in a direction opposite to a mounting direction in which the liquid supply member is mounted onto the liquid consumption apparatus, when the liquid supply member is removed from the liquid delivery unit.

7. The liquid consumption apparatus according to claim 1, wherein a delivery port is formed on the liquid delivery unit, and a second absorbent material configured to absorb the liquid is provided so as to contact the liquid delivery unit at a position further in a mounting direction in which the liquid supply member is mounted onto the liquid consumption apparatus, than the delivery port.

8. The liquid consumption apparatus according to claim 7, wherein the second absorbent material is in contact with an inner wall of the liquid accepting unit.

9. A liquid supply member mounted onto a liquid consumption apparatus, the liquid consumption apparatus including a liquid delivery unit for delivering liquid into the liquid consumption apparatus and a liquid accepting unit for catching inadvertently spilled or sprayed liquid, the liquid accepting unit being provided below the liquid delivery unit, the liquid supply member comprising:

a liquid supply unit configured to connect to the liquid delivery unit to supply a liquid to the liquid delivery unit; and a surface on which is formed an indent that, in a state where the liquid supply member is mounted to the liquid consumption apparatus, accommodates at least a part of the liquid accepting unit.

10. The liquid supply member according to claim 9, further comprising a contact section that, in a state where the liquid supply member has been mounted onto the liquid consumption apparatus, abuts against one end of a member of which the other end is detected by the liquid consumption apparatus, the indent being, in a state where the liquid supply member is mounted onto the liquid consumption apparatus, positioned above the contact section.

11. A liquid supply system comprising:

the liquid supply member according to claim 9; and a liquid storage unit configured to store the liquid being supplied to the liquid supply member.

12. The liquid supply system according to claim 11, further comprising a tube through which the liquid is supplied from the liquid storage unit to the liquid supply member.

* * * * *